US008177602B1

(12) United States Patent
Kaytes

(10) Patent No.: US 8,177,602 B1
(45) Date of Patent: May 15, 2012

(54) APPARATUS AND METHOD FOR ENHANCING A WOMAN'S CLEAVAGE WITH FLOATING BRASSIERE CUPS

(76) Inventor: Seka Kaytes, Delray Beach, FL (US)

( * ) Notice: Subject to any disclaimer, the term of this patent is extended or adjusted under 35 U.S.C. 154(b) by 839 days.

(21) Appl. No.: 12/174,580

(22) Filed: Jul. 16, 2008

Related U.S. Application Data

(60) Provisional application No. 60/950,211, filed on Jul. 17, 2007, provisional application No. 61/044,895, filed on Apr. 14, 2008.

(51) Int. Cl.
*A41C 3/00* (2006.01)

(52) U.S. Cl. ..... 450/60; 450/61

(58) Field of Classification Search ..... 450/59–63, 450/65–68, 92, 93, 78; 2/67, 73, 78.1–78.4, 2/104, 105, 113–115, 90
See application file for complete search history.

(56) References Cited

U.S. PATENT DOCUMENTS

| | | | | |
|---|---|---|---|---|
| 1,345,216 | A | 6/1920 | Narbett | |
| 1,590,693 | A * | 6/1926 | McKeefrey | 450/61 |
| 1,655,224 | A | 1/1928 | Hirsch | |
| 1,993,734 | A | 3/1935 | Edekheit | |
| 2,407,574 | A * | 9/1946 | Panes | 450/68 |
| 2,523,715 | A * | 9/1950 | Panes | 450/60 |
| 2,641,763 | A | 6/1953 | Schoeder | |
| 2,734,193 | A * | 2/1956 | Croxxall | 450/63 |
| 2,908,276 | A | 10/1959 | May | |
| 3,196,878 | A | 7/1965 | Hedu | |
| 4,325,378 | A | 4/1982 | Wilkinson | |
| 4,412,357 | A | 11/1983 | Mincher | |
| 4,955,846 | A | 9/1990 | Greenberg | |
| 5,590,443 | A * | 1/1997 | Fildan | 24/200 |
| 5,609,042 | A | 3/1997 | Williams | |
| 5,868,601 | A | 2/1999 | Kelemencky | |
| 6,247,207 | B1 | 6/2001 | Nitsche | |
| 6,390,884 | B1 | 5/2002 | Dragojevic | |
| 6,575,811 | B1 | 6/2003 | Fildan et al. | |
| 7,452,260 | B2 * | 11/2008 | Redenius | 450/63 |
| 7,497,760 | B2 * | 3/2009 | Redenius | 450/60 |
| 7,517,273 | B2 * | 4/2009 | Wooten | 450/63 |
| 7,645,179 | B2 * | 1/2010 | Redenius | 450/60 |

* cited by examiner

*Primary Examiner* — Gloria Hale
(74) *Attorney, Agent, or Firm* — John C. Smith

(57) ABSTRACT

A brassiere with floating cups which are independently positionable in relation to the brassiere body. Depending on the point of attachment to the brassiere, the floating brassiere cups control the support, position, cleavage, and separation of individual breasts. The floating cups are partially or fully detached from the brassiere at various selectable locations. It is not just rotational motion, but also lifting the breasts upward and toward the center of the chest. The brassiere has floating cups that apply rotational pressure to move the breasts closer together if rotated in one direction, and will move the breasts apart if rotated in the other direction. The cup positioning mechanism can be implemented by an adjustable clip, by integral hook and loop strips, buttons, ornamental clasps, straps, string ties, or other suitable devices.

11 Claims, 13 Drawing Sheets

APPARATUS AND METHOD FOR ENHANCING A WOMAN'S CLEAVAGE WITH FLOATING BRASSIERE CUPS

CROSS-REFERENCE TO RELATED APPLICATIONS

This application is related to, and claims the benefit of, the provisional patent application entitled "Apparatus And Method For Enhancing A Woman's Cleavage With A Floating and Sliding Cup Brassiere", filed Jul. 17, 2007, bearing U.S. Ser. No. 60/950,211 and naming Seka Kaytes, the named inventor herein, as sole inventor, the contents of which is specifically incorporated by reference herein in its entirety, and the provisional patent application entitled "Apparatus And Method For Enhancing A Woman's Cleavage With A Floating and Sliding Cup Brassiere", filed Apr. 14, 2007, bearing U.S. Ser. No. 61/044,895 and naming Seka Kaytes, the named inventor herein, as sole inventor, the contents of which is specifically incorporated by reference herein in its entirety.

BACKGROUND

1. Technical Field

The present invention relates to breast support devices. In particular, it relates to a brassiere having "floating" cups that are fully or partially detached from the brassiere structure for the purpose of independently positioning the cups without disturbing the position of the brassiere as a whole. Independently movable floating brassiere cups allow the wearer to dynamically adjust the manner in which the brassiere supports and controls the position of the breasts and to enhance the breasts' cleavage, and to enhance the perceived fullness and firmness of the breasts. In addition, the floating cup solves the problem of approximately eighty percent of females who are wearing the wrong size bra.

2. Background of the Invention

The use of brassieres to support a woman's breasts is well-known in the art. Traditionally, these devices have provided support for the breasts, but they do not allow individual custom positioning of the cups or the breast. More recently, attempts have been made to enhance the cleavage and appearance of a woman's breasts by pushing-up and pushing-in the individual breast using push-up cups or adding push-up inserts into the brassiere, or by pulling brassiere cups together via straps, thereby enhancing the perceived size of the breasts as well as the cleavage.

While prior art brassieres serve their purpose to an extent, they also have disadvantages. In particular, prior art brassieres are restricted in how much bra cups can be moved inward because the cups are attached to the brassiere and their movement is limited. As a result, the cleavage enhancement they provide is limited. This is particularly true for females having a small breast size, such as A and B size cups. With prior art brassieres, typically only larger breast size females have significant cleavage enhancement.

Another disadvantage associated with the prior art is that cups are fully attached and fixed in one position (i.e. cups are not movable) to a brassiere as a whole, when cups are moved toward each other it pulls on the entire garment and disturbs the position of a brassiere, thus resulting in: (a) Improper garment fit, (b) Tightness of the chest because of fabric pulling, (c) Discomfort, (d) Fabric wrinkling on the side of the bra back, and (e) Insignificant cleavage enhancement for bra cup sizes A and B.

Another disadvantage associated with prior art brassieres is that when breasts are pulled together laterally for the purpose of enhancing cleavage, the brassiere also occasionally produces some undesirable side effects. In particular, when the brassiere pulls the breasts together, it sometimes creates the appearance of creases or wrinkles in the breasts which make the breasts unattractive and increases the apparent age of the woman. It would be desirable to have a method of adjusting and controlling a brassiere such that the cleavage of a woman could be improved while still maintaining a smooth surface texture on the skin of the breasts.

Another disadvantage associated with prior art brassieres is that studies have shown that a significant percentage of women, up to eighty percent in some cases, wear the wrong size brassiere, which results in discomfort. It would be desirable to have a brassiere in which the cups could be independently adjusted to accommodate a wider variety of breast and body shapes such that the brassieres provide a more comfortable fit.

While addressing the basic desirability of using brassieres, the prior art has failed to provide a device which allows woman with any breast size, including smaller cup sizes such as A and B, to dynamically control the amount of cleavage provided by a brassiere, which allows an individual woman to dynamically control the perceived size of the breasts, and the position and cleavage of each breast independent of the other breast without the drawbacks of the prior art, and which allows each cup to be individually positioned to maximize comfort.

SUMMARY OF THE INVENTION

The present invention solves the foregoing problems by providing a brassiere which has independently adjustable floating cups that are partially or fully detached from the brassiere as a whole, that allow the wearer, in particular a small bra cup female such as A and B, to have maximum benefits of a natural cleavage by independently changing the position of each cup and thereby repositioning the breast. Depending on the point of attachment of the cup to cup attachment points on the brassiere body, each cup of the brassiere is independently rotated, raised, lowered, or pulled in a lateral direction. The ability to independently move individual cups in relation to the brassiere body provides a "Give-In" feature that accommodates in-between sizes, and also accommodates breasts which are asymmetrical or vary in size from one another.

By attaching the brassiere cups at various locations, the brassiere cups which hold the breasts are independently positioned by the wearer to allow the cleavage and perceived size of each breast to be individually adjusted to compensate for slightly asymmetrical breasts. Further, the ability to individually position cups provides the wearer to adjust the cups for maximum comfort.

The present invention also provides an alternative embodiment that has cups which are separate from the brassiere. Namely, brassiere cups that are inserted into a brassiere or other top garment.

DETAILED DESCRIPTION OF THE PREFERRED EMBODIMENT

Prior to a detailed discussion of the figures, a general overview of the features and advantages of the invention will be presented. As noted above, attempts have been made to enhance the cleavage and appearance of a woman's breasts through the use of devices associated with brassieres. Most notably, the attempts have been confined to pulling the cups of the brassiere together or increasing the support provided by a brassiere to lift the breasts. While this has been successful to a point, it has the drawbacks discussed above in regard in that not all individuals would benefit with the amount of cleavage equally. For example, small breast sized women, such as those having size A and B do not have any significant results with prior art brassieres. Further, it induces an additional problem in that when the brassiere cups are pulled together laterally to increase cleavage, a side effect occurs in which the skin on the top surface of the breast becomes wrinkled creating the illusion that the individual is older than the individual actually is.

The invention uses a floating cup structure in which a floating cups move independently from the brassiere body. The floating cups allow greater freedom to independently position each cup, not only laterally, but also up or down. As a result, a woman can adjust the brassiere not only to enhance cleavage and/or apparent fullness, but also to address comfort and other physical issues.

In particular, an advantage provided by the invention is that by allowing individual breasts to be independently positioned in a variety of directions: up, down, from left to right and vice versa, from bottom left to top right and vice versa, from bottom right to top left and vice versa, rotation in clockwise direction and counter clockwise, an individual can manipulate each breast to suit particular physical needs, and the brassiere cups will support the new position of the breast. For example, if a wearer has non-symmetrical breasts, one or both cups can be adjusted to give the appearance of symmetry. Likewise, if one breast is smaller than the other, a wearer can adjust an individual cup to give the appearance of greater size. A further advantage provided by the floating cups is that by being detached from the brassiere body, they have a "give-in" feature that stretches to accommodate a breast if it becomes larger due to swelling, pregnancy or weight gain.

Figure 1:
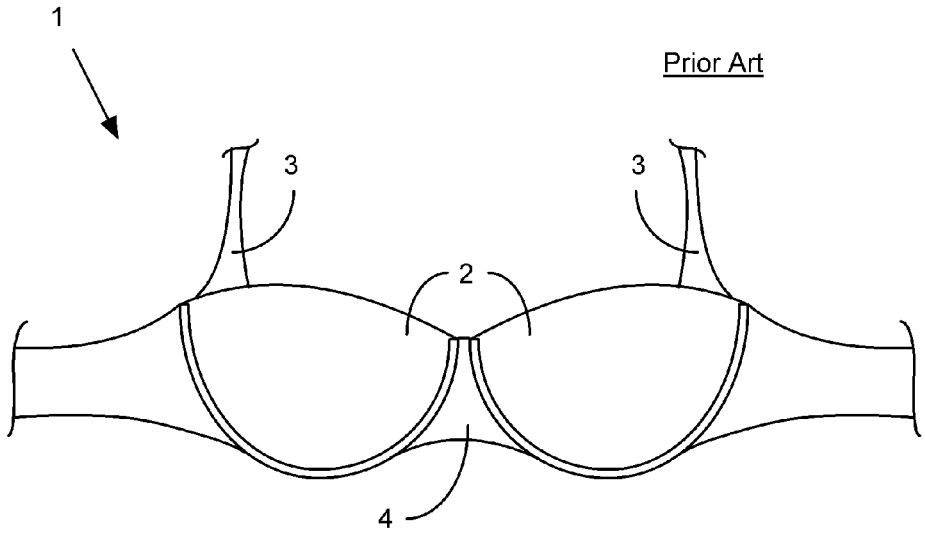
FIG. 1 is a front view of a prior art brassiere which illustrates a brassiere that does not modify cleavage.
Figure 2:
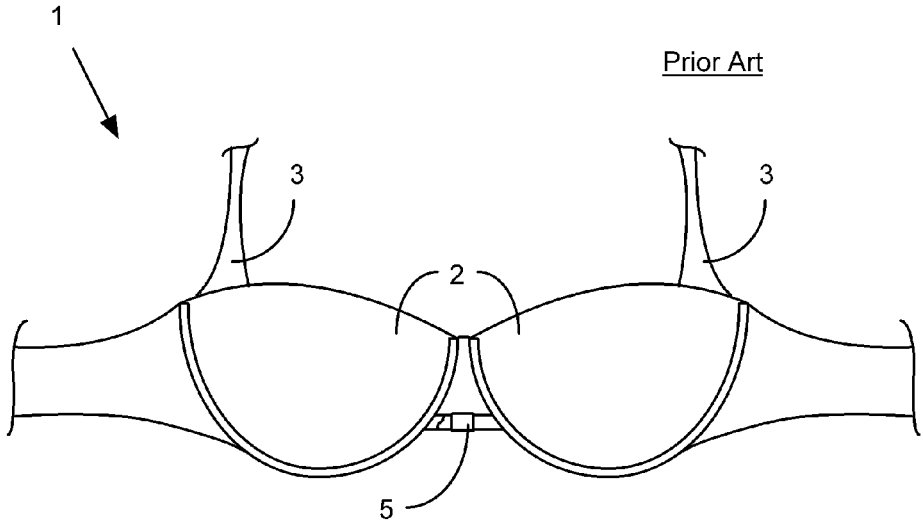
FIG. 2 illustrates a front view of a prior art brassiere which has tension straps placed in between the brassiere cups that pull the brassiere cups together to enhance cleavage.

Having discussed the invention in general, we turn now to a more detailed discussion of the figures. FIGS. 1-2 illustrate prior art conventional brassieres, the remaining figures illustrate the floating cup embodiment.

Referring to FIG. 1, this figure shows a prior art brassiere 1. In this figure, the brassiere 1 has two cups 2 which support the wearer's breasts. The cups 2 are supported by shoulder straps 3. Also shown in this figure is center front 4. In this type of conventional brassiere 1, the brassiere 1 supports the breasts and does not manipulate their position.

FIG. 2 illustrates another type of prior art brassiere 1 that attempts to enhance cleavage. In this embodiment, brassiere cups 2 are connected by a tension strap 5 which pulls the cups 2 of the brassiere 1 together. As the cups 2 are pulled together, the breasts are pulled toward the center of the brassiere to enhance cleavage. Likewise, the straps 3 can be used to provide upward pressure to the brassiere cups 2. Unfortunately, this type of prior art brassiere 1 merely pulls the cups 2 together laterally, and has no advantage for smaller size breasts such as A and B cup size females. A disadvantage of this method is that it often distorts the appearance of the breast, and in addition, it may cause wrinkling of the skin on top of the breasts while it is won. As a result, the benefits of improved cleavage may be offset by the appearance of wrinkles and the illusion of advanced age which is caused by an improperly fit bra that is tight around chest as it pulls on entire garment.

Figure 3A:
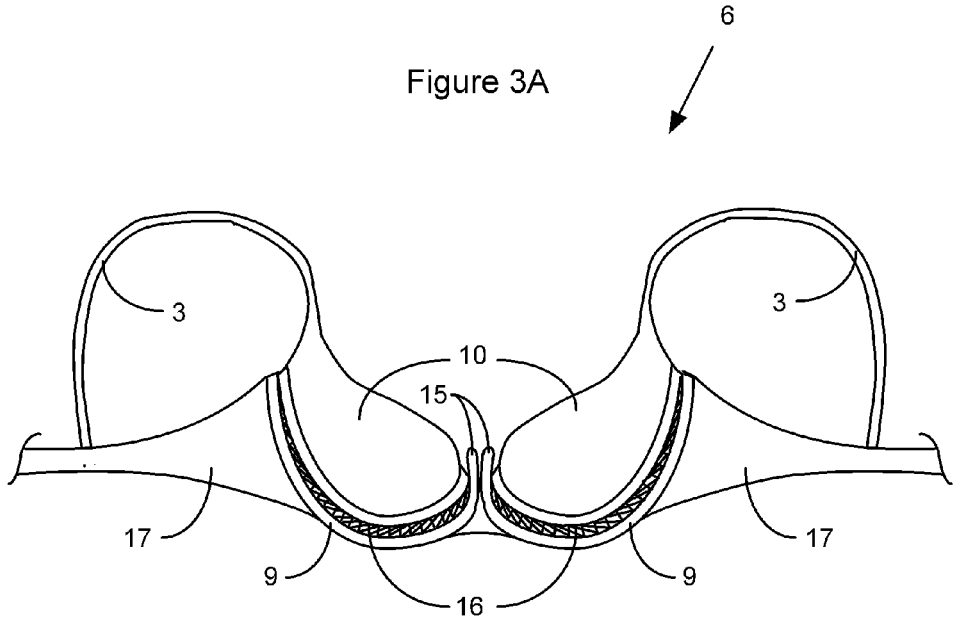
FIG. 3A illustrates a front view of a preferred embodiment of the brassiere in which the brassiere cups are shown fully detached from the brassiere and held in place by stretch fabric. The brassiere cups are shown in the lowered position in this figure. Bra cups are attached to bra straps; locking mechanism is placed on cup holder and on bra cups too.

FIG. 3A illustrates a front view of a preferred embodiment of the brassiere 6 in which the brassiere cups 10 are shown in the lowered position. Floating cup 10 is fully detached from the brassiere body 17 and it is independently movable. Decorative elastic fabric 16 is positioned between brassiere body 17 and the bottom of floating cups 10. Alternatively, floating cups 10 can be covered with decorative fabric 16 on both sides in a sandwich structure where cups 10 are held in place by decorative fabric 16 and shoulder straps 3. Maneuvering cups 10 in any direction will not disturb the position of the brassiere body 17 or shoulder straps 3. For ease of illustration, the shoulder straps 3 are shown as part of the brassiere cups 10. However, those skilled in the art will recognize that while optional shoulder straps 3 are shown throughout the figures as attached to the floating cups 10, they can also be entirely disconnected from the floating cups 10. Likewise, many brassieres 6 do not have shoulder straps 3 for fashion reasons.

Also shown in this figure are cup attachment points 15. Cup attachment points 15 are the end portions of the bottom support wires 9 which are secured to brassiere body 17. When the cups 10 are raised, they are secured to cup attachment points 15. In addition, bottom support wire 9 can be a simple wire structure.

Figure 3B:
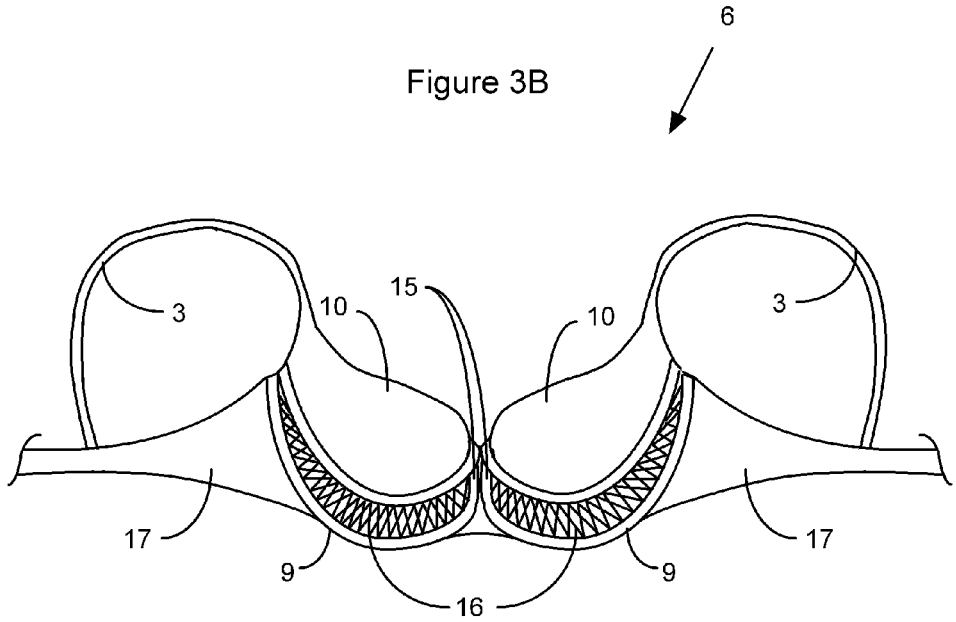
FIG. 3B illustrates a front view of a preferred embodiment of the brassiere in which the tips of the support wires form cup support posts which are positioned between the brassiere cups. The brassiere cups are shown in the raised position in this figure.

FIG. 3B illustrates a front view of the preferred embodiment of FIG. 3A. In this figure, the brassiere cups 10 are shown in the raised position. Cup attachment points 15 are secured to the cups 10. The cups 10 are held in the raised position by cup attachment points 15. In addition, the cup attachment points 15 can be sewn into the floating cups 10 at the point of manufacture without requiring any additional attachments.

Figure 4A:
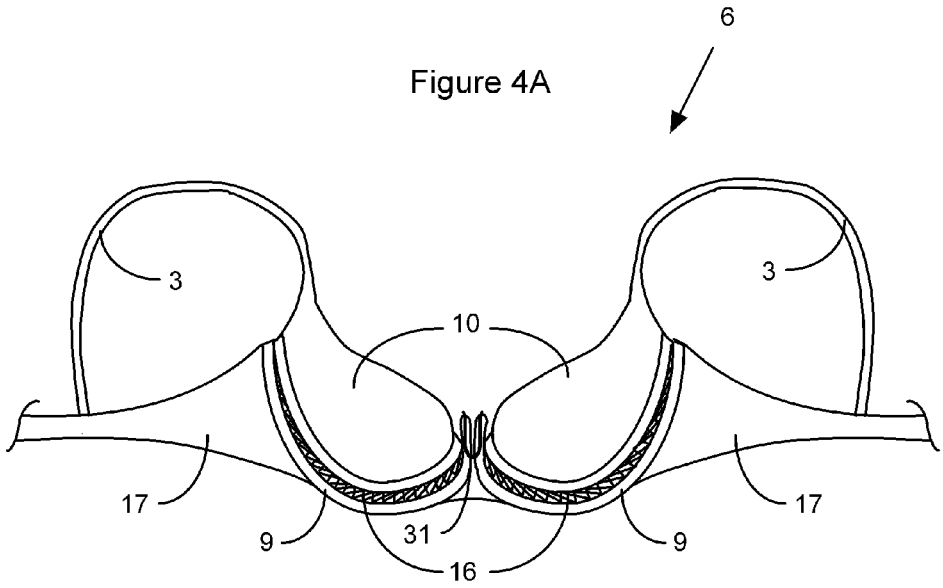
FIG. 4A illustrates a front view of an alternative preferred embodiment of the brassiere in which a decorative cup retainer is positioned between the brassiere cups. The brassiere cups are shown in the lowered position in this figure.

FIG. 4A illustrates a front view of an alternative preferred embodiment of the brassiere 6 in which a cup retainer 31 is secured to the attachment points 15 or the bottom support wires 9. In use, cup retainer 31 can then be secured to one or more locations on the cup 10 and brassiere 6. The cups 10 are then positioned based on where they are attached. The floating cups 10 are shown in the lowered position in this figure.

Figure 4B:
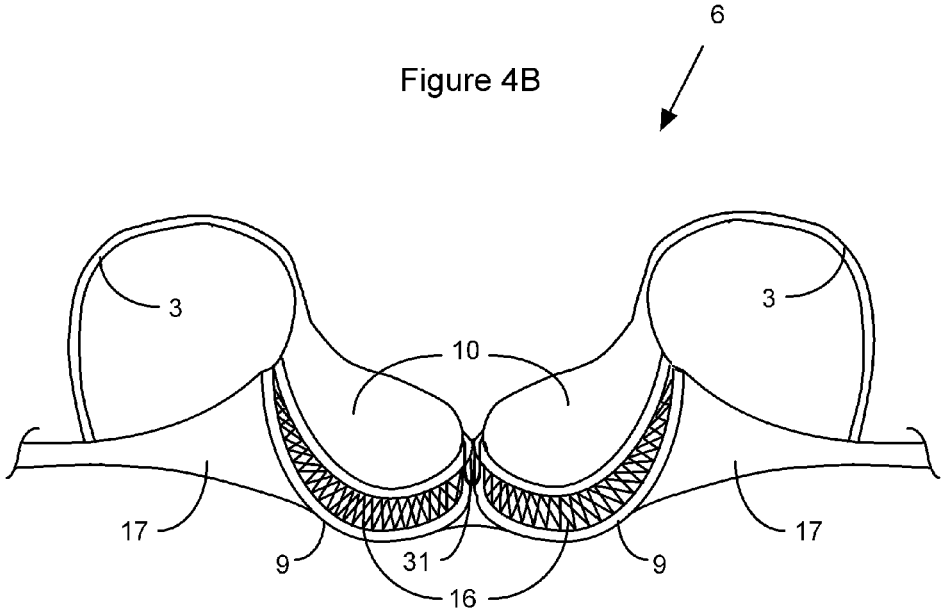
FIG. 4B illustrates a front view of an alternative preferred embodiment of the brassiere in which a decorative cup retainer is positioned between the brassiere cups and functions as a front closure to keep the brassiere cups in a raised position. The brassiere cups are attached to the decorative cup retainer and shown in the raised position in this figure.

FIG. 4B illustrates a front view of the alternative preferred embodiment of FIG. 4A in which the cup retainer 31 is positioned between the floating cups 10. The floating cups 10 are attached to the cup retainer 31 and shown in the raised position in this figure.

FIGS. 4A-B also illustrates the use of decorative stretchable fabric panels 16 which are positioned between the brassiere cups 10 and the brassiere body 17.

Figure 5A:
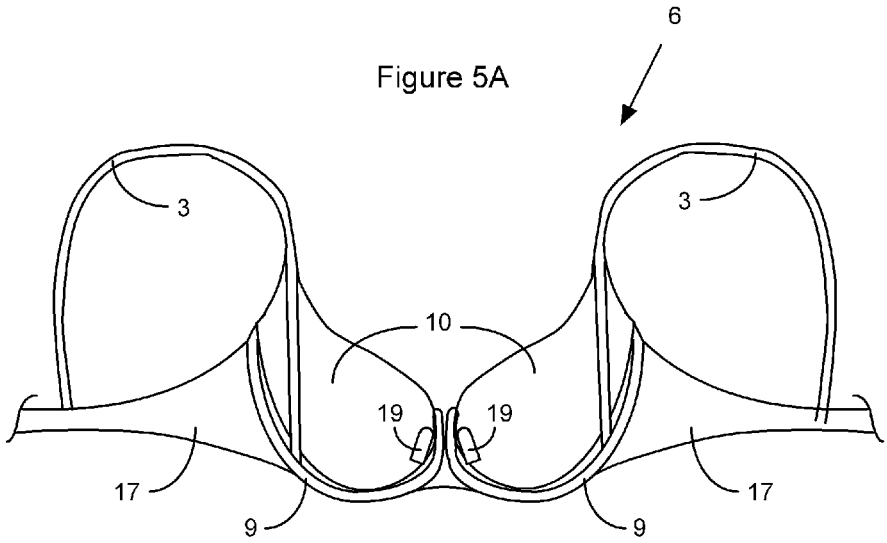
FIG. 5A is a rear view of an alternative preferred embodiment which uses securing pockets that are integrated with the floating cups that secure to the support wire of the brassiere to hold the floating cup in a preselected position.

FIG. 5A illustrates a rear view of an alternative preferred embodiment which uses a securing pocket 19 that is integrated with the floating cup 10 to secure it to bottom support wire 9 of the brassiere 6. In the preferred embodiment, the securing pocket 19 accepts the tip of support wire 9. The securing pockets 19 slip over the tips of the bottom support wires 9 to secure the brassiere cups 10 in a particular position. When the wearer wants to lower the floating brassiere cups 10, she merely pulls the securing pockets 19 off of the tips.

Those skilled in the art will recognize that multiple securing pockets 19 can be used by floating cups 10 to allow the wearer to adjust the movement of each floating cup 10 to any one of a number of predetermined positions by simply moving the floating cup 10 to the left, right, up or down position where the tip will go in specific securing pocket 19. Of course, each floating cup 10 can be individually adjusted in this manner. Likewise, the securing pockets 19 are shown as discrete components for ease of illustration. However, for wearer comfort, the securing pockets 19 are envisioned as pockets that may be sewn into the floating cups 10.

Likewise, for ease of illustration, optional shoulder straps 3 are shown attached to bottom support wire 9. However, those skilled in the art will recognize that the shoulder straps 3, if used, can be secured to the bottom support wire 9, the top support wire 8, the brassiere body 17, or the floating cups 10. The choice of where the shoulder strap 3 is attached to the brassiere 6 will be governed by design considerations related to aesthetics, etc.

Figure 5B:
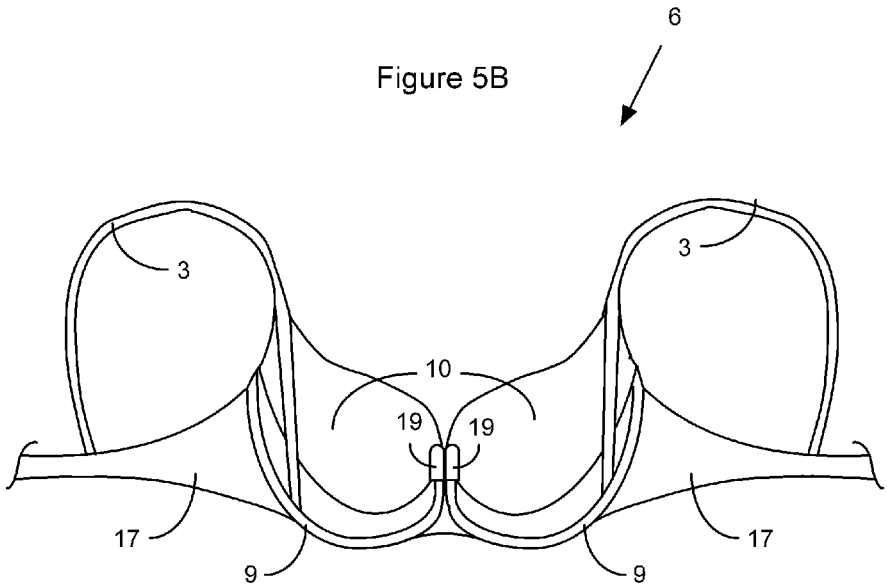
FIG. 5B is a rear view of the embodiment shown in FIG. 5A which illustrates the floating cup in a raised position.

FIG. 5B is a rear view of the embodiment shown in FIG. 5A. It further illustrates the attachment of the securing pocket 19 to the tip 12 of the bottom support wire 9 of the brassiere 6. To raise the floating cup 10, the wearer merely needs to lift the floating cup 10 upwards to allow the tip 12 of the support wire 9 to slide into it. Cups 10 can also be positioned in raised position at the point of manufacturing, which will result in custom pre adjusted cup position for a particular brassiere size. Of course, the more securing pockets 19 which are provided, the more flexibility the wearer will have when positioning their breasts.

To lower the floating cup 10, the wearer simply reverses the process. Those skilled in the arts will recognize that the securing pocket 19 can be constructed such that it has multiple slots at varying positions to allow the user to adjust the position of the floating cup 10. FIG. 5B also illustrates the brassiere strap 3 attached to a bottom support wire 9. Alternatively, brassiere strap 3 can be attached to both cup 10 and one or both top support wire 8 (not shown in this figure) or bottom support wire 9. In the case where no top support wire 8 or bottom support wire 9 are not used, the brassiere strap 3 can be attached directly to the brassiere body 17.

Figure 6:
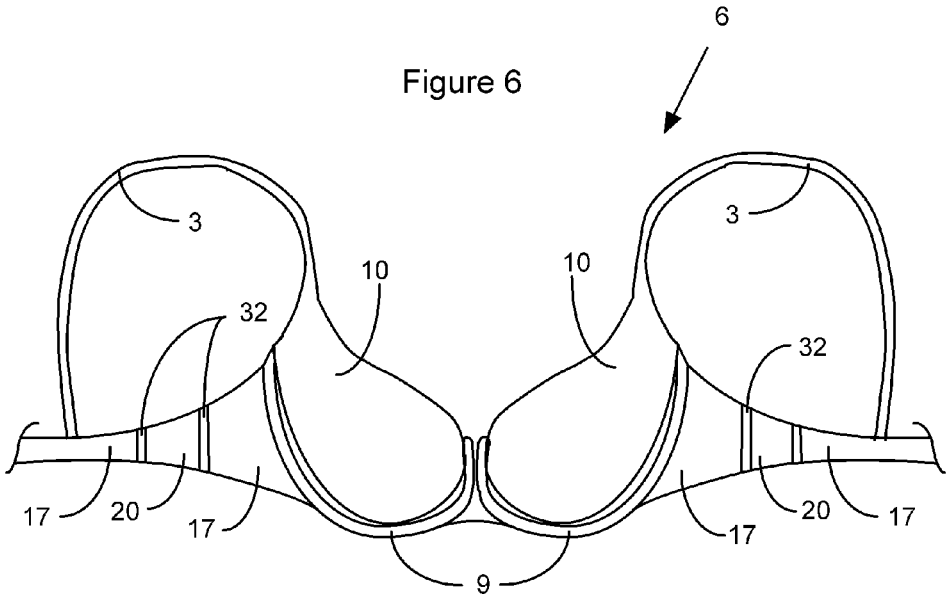
FIG. 6 is a front view of an alternative preferred embodiment of the invention which uses elastic panels with elastic fabric on the side of the brassiere, to give the brassiere cup extra movement without pulling on the bra back.

FIG. 6 is a front view of an alternative preferred embodiment of the brassiere 6 which uses elastic side panels 20 on the brassiere body 17 of the brassiere 6. These optional elastic side panels 20 contain extra stretch material for the purpose of providing additional comfort and serve as a flexible barrier between the brassiere cups 10 and the brassiere body 17, so that pulling the brassiere cups 10 toward each other will not disturb the position of the brassiere body 17. Also shown are optional support ribs 32, which maintain the brassiere 6 in its proper shape.

Figure 7A:
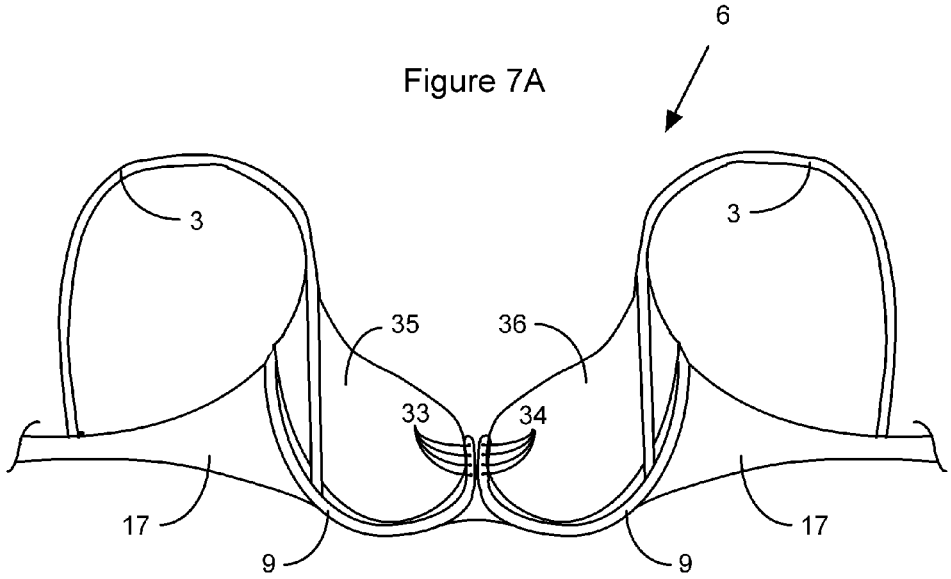
FIG. 7A is a rear view of an alternative preferred embodiment which uses floating cups that may be secured to the opposing bottom support wire. In this case, the brassiere cups are not secured to the opposing cup's bottom support wires, and are shown in the lowered and apart position.

FIG. 7A is a rear view of an alternative preferred embodiment of the brassiere 6 which uses the "shoe string technique" in which floating cups 35, 36 are secured to the opposing support wires 9. The floating cups 35, 36 may be attached to the support wire 9 which is associated with that cup 35 or 36, or the floating cup 35 may be attached to attachment points 34 on the opposing support wire 9, and floating cup 36 may be attached to attachment points 33 on the opposing support wires 9. By using attachment points 33, 34 on the opposing support wires 9, the wearer has the ability to increase the amount of movement of the floating cups 35, 36 toward one another. A plurality of cup attachment points can be incorporated into floating cups 35, 36 to allow attachment of the cups 35, 36 to any of the attachment points 33, 34 on bottom support wires 9. Any suitable method of securing the cup attachment points can be used. Also, the attachment points 33, 34 can be placed at any suitable location of a top wire 8, a bottom wire support 9, a cup 10, or on any suitable part of the brassiere 6. Any suitable means can be used to secure the floating cups 35, 36 to the attachment points, including straps, conventional brassiere closures, custom-made closures, snaps, hooks, etc. This allows each floating cup 35 to 36 to move independent of the brassiere body 17. This provides improved comfort, and also allows greater ability to independently manipulate the position of each breast.

For ease of illustration and discussion only four attachment points 33 and four attachment points 34 are shown. However, those skilled in the art will recognize that any suitable number of attachment points can be used to provide the greatest control over how the breasts are positioned.

Figure 7B:
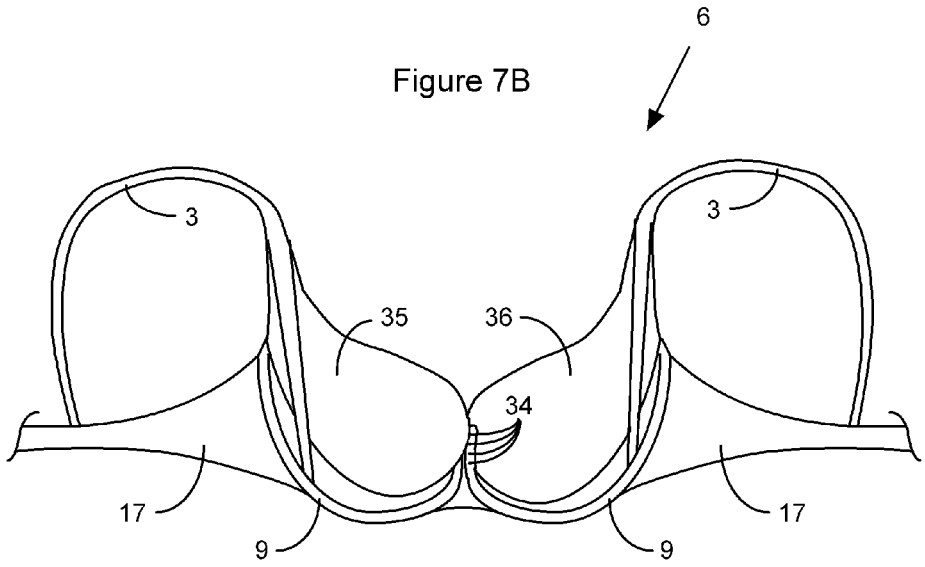
FIG. 7B is a rear view of the alternative preferred embodiment of FIG. 7A. In this figure, the floating cups are secured to the opposing cup's bottom support wires and are shown in the raised and pulled together position.

FIG. 7B is a rear view of the alternative preferred embodiment of FIG. 7A which are secured to the bottom support wire 9. In this figure, the floating cups 10 are shown in the raised and pulled together position and secured to the opposing bottom support wire 9. As noted above, the additional distance provided by attaching left and right floating cups 35, 36 to the opposing bottom support wires in 19 allows the wearer to increase the distance which the floating cups 35, 36 may be moved.

Figure 7C:
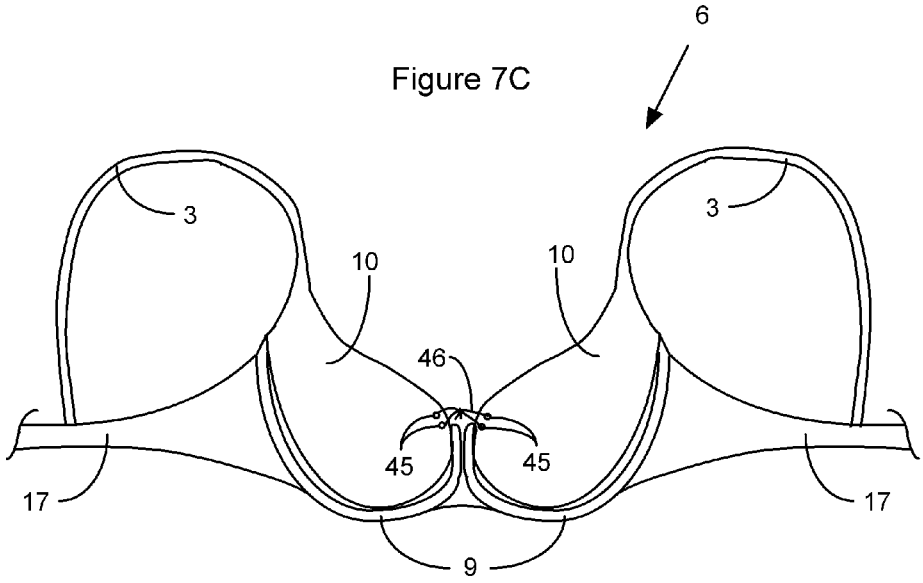
FIG. 7C is a front view of a floating cup brassiere and illustrates and alternative embodiment of the shoe-string technique which allows floating cups to be brought closer together by tying opposing cups directly together.

FIG. 7C is a front view of the shoe-string technique that can be used with the floating cups 10. The shoe-string technique allows the floating cups 10 to be brought closer together by securing the ties 46 together such that the floating cups 10 are pulled closer together to improve cleavage. In this embodiment, apertures 45 are located near the edge of each floating cup 10. String ties 46 are inserted through the apertures 45 on each floating cup 10 and secured together. This technique can be used with any of the embodiments disclosed herein.

Figure 8A:
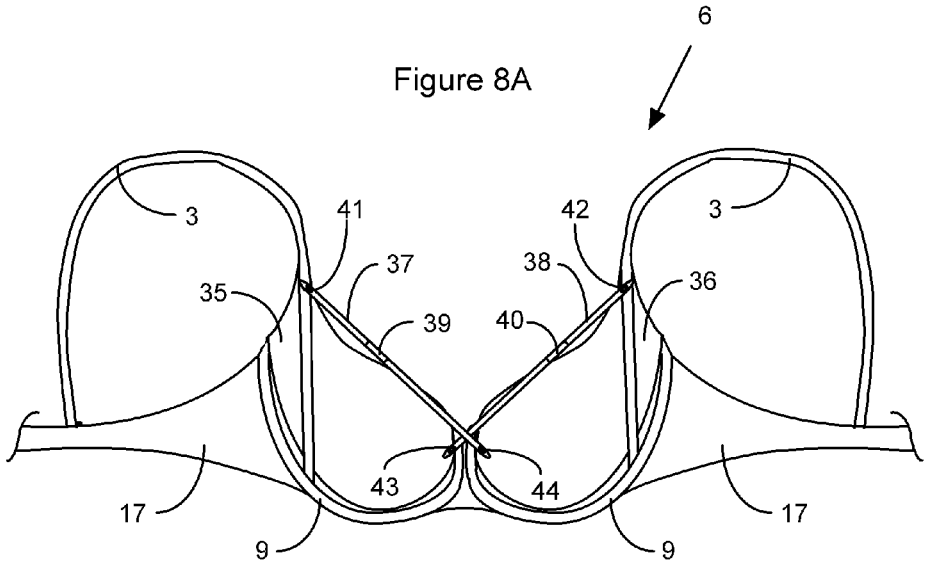
FIG. 8A is a rear view of an alternative preferred embodiment which uses floating cups that are secured by opposing straps, at the top and to the middle of the brassiere cup. Floating cups are shown in the lowered position. Opposing straps are shown as adjustable.

FIG. 8A is a rear view of another alternative preferred embodiment of the brassiere 6 which uses floating cups 35, 36 which are secured by adjustable tension straps 37, 38, respectively. In this embodiment, the floating cups 35, 36 move free of the bottom supporting wire 9. Adjustable tension straps 37, 38 are attached to each floating cup 35, 36 such that they create a crisscross connection for brassiere cups 35, 36. As tension adjustments 39, 40 are adjusted, the tension on tension straps 37, 38 is altered. As a result, the floating cups 35, 36 can be rotated to adjust the amount of cleavage. Tension straps 37, 38 can be placed at any convenient location on the brassiere 6 at the point of manufacturing or selectively positioned by the wearer. The tension straps 37, 38 can be attached at first strap attachment points 41, 42 to their respective floating cup 35, 36, or attached to their respective shoulder straps 3. Likewise, tension straps 37, 38 can be attached at second attachment points 43, 44 to cups 35, 36 or to opposing bottom support wires 9 as shown in the figure. This figure illustrates the floating cups 35, 36 in the lowered position.

Figure 8B:
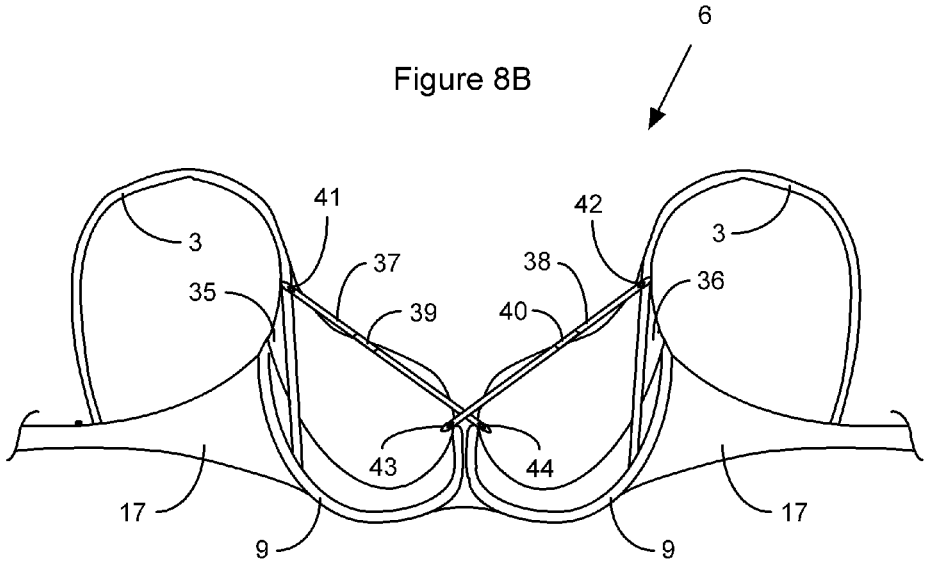
FIG. 8B is a rear view of the alternative preferred embodiment of FIG. 8A. The floating cups are in the raised and closed together position via adjusting the opposing straps.

FIG. 8B is a rear view of the alternative preferred embodiment of FIG. 8A where floating cups 10 are secured by suspension straps 23, 24. In this figure, the suspension straps 23, 24 have been tightened to allow the floating cups 10 to be raised and to bring floating cups 10 closer together so as to alter the perceived cleavage. The adjustable straps 23, 24 can be attached to the brassiere floating cup 10, or the support wire 9.

Figure 9A:
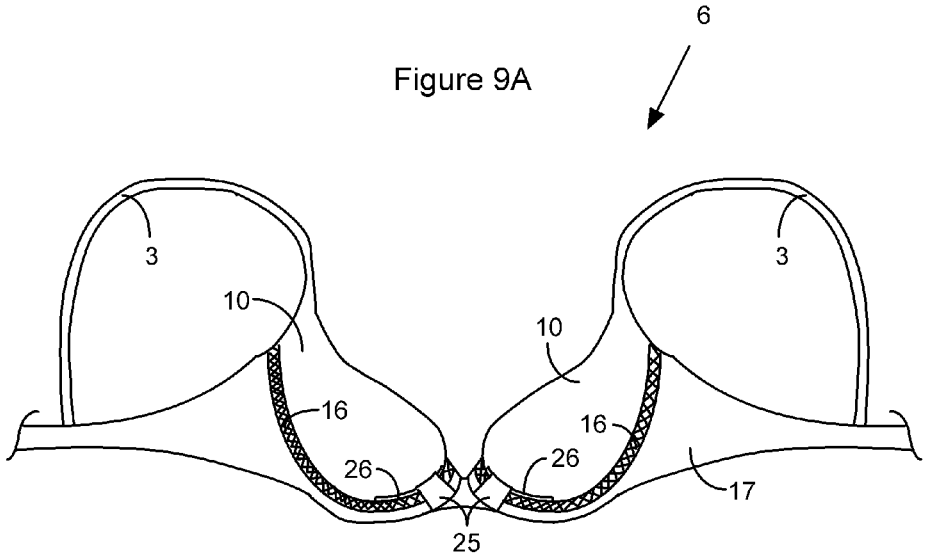
FIG. 9A is a front view of an alternative preferred embodiment which uses floating cups that are secured to a brassiere body via an adjustable cup securing assembly. The floating cups are shown in the lowered position.

FIG. 9A is a front view of an alternative preferred embodiment of the brassiere 6 which uses floating cups 10 that are secured to the brassiere body 17. In this figure, the first portion 25 of the cup securing assembly 25, 26 is secured to the brassiere body 17 and remains stationary. The second portion 26 of the cup securing assembly 25, 26 is attached to the floating cup 10 and movably attached to the first portion 25 such that it can move from one position to another and be secured at any selected position. The cup securing assembly 25, 26 allows the user to adjust the location of the floating cups 10 to any desired position. The cup securing assembly 25, 26 can be a simple pressure clamping mechanism or alternatively have a series of locking points which allow the second portion 26 to be selectively stepped from one position to another. In this figure, the floating cups 10 are shown in the lowered position.

Optional fabric 16 may be used for cosmetic purposes to cover the area between the brassiere body 17 and the floating cups 10. Likewise, the brassiere 6 may optionally employ top support wires 8 (not shown in this figure) and/or bottom support wires 9 (not shown in this figure). If used, the cup securing assembly 25, 26 may be secured to top support wires 8 and/or bottom support wires 9.

For ease of illustration, this embodiment has been shown with a cup securing assembly 25, 26 which is relatively short in length. However, the cup securing assembly 25, 26 may have any suitable length for its purpose.

Figure 9B:
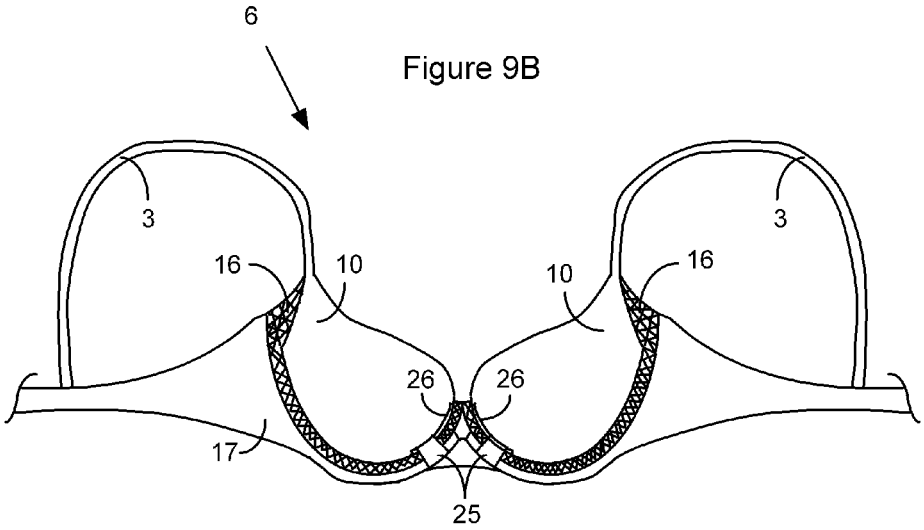
FIG. 9B is a front view of the alternative preferred embodiment of FIG. 9A which shows the floating cups secured together in the raised position.

FIG. 9B is a front view of the alternative preferred embodiment of the brassiere 6 of FIG. 9A which uses floating cups 10 that are secured by a cup securing assembly 25, 26. In this figure, second portion 26 has been moved upward and is held in place by first portion 25. As a result, the breasts are moved to a raised position.

Figure 10:
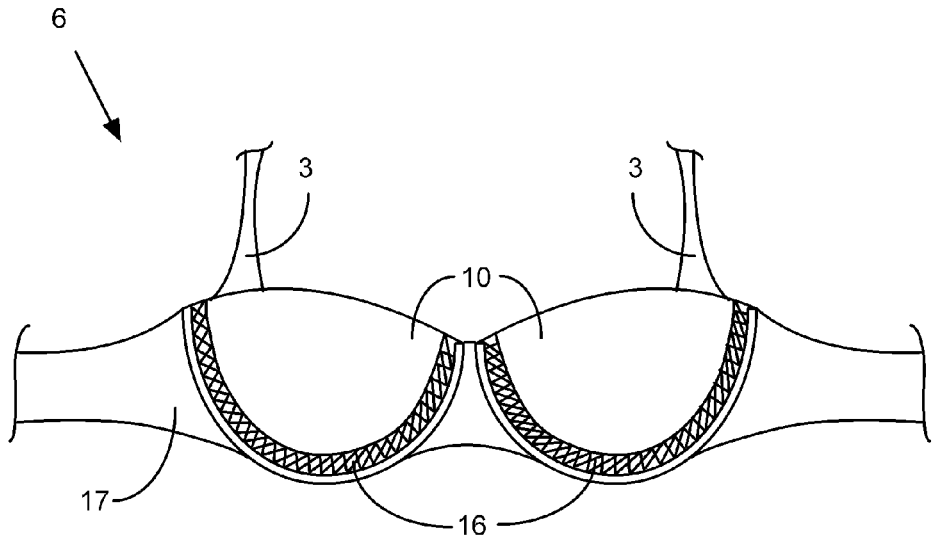
FIG. 10 is a front view of a floating cup brassiere and illustrates the floating cups connected to the brassiere with stretch-lace material.

FIG. 10 is a front view of a preferred embodiment of a floating cup brassiere 6 that illustrates the floating cups 10 connected to the floating cup brassiere 6 with an elastic material 16 which can be fabricated from a stretch-lace material or any other suitable material. In this embodiment, floating cup brassiere 6 is shown without attachments and illustrates the floating brassiere cups 10 connected to the floating cup brassiere 6 with stretch-lace material 30. By attaching the floating cups 10 in this manner, they have great amount of movement as they are not fixed to the floating cup brassiere 6. Adjusting the shoulder straps 6 allows the wearer to custom adjust the floating brassiere cups 10 to a desired comfortable position. This 'give-in' cup feature also benefits both the manufacturer and retailer as it will reduce returns because more differently shaped women can be comfortably fit by the floating cup brassiere 6. Also, women do not have to purchase bigger size brassieres for the days that their breasts are swollen due to a menstrual cycle. Likewise, it will eliminate the need to purchase larger sized brassieres for occasions when women gains extra weight. In addition, the "give-in" cup feature accommodates in-between sizes, and different size proportion breasts.

Figure 11:
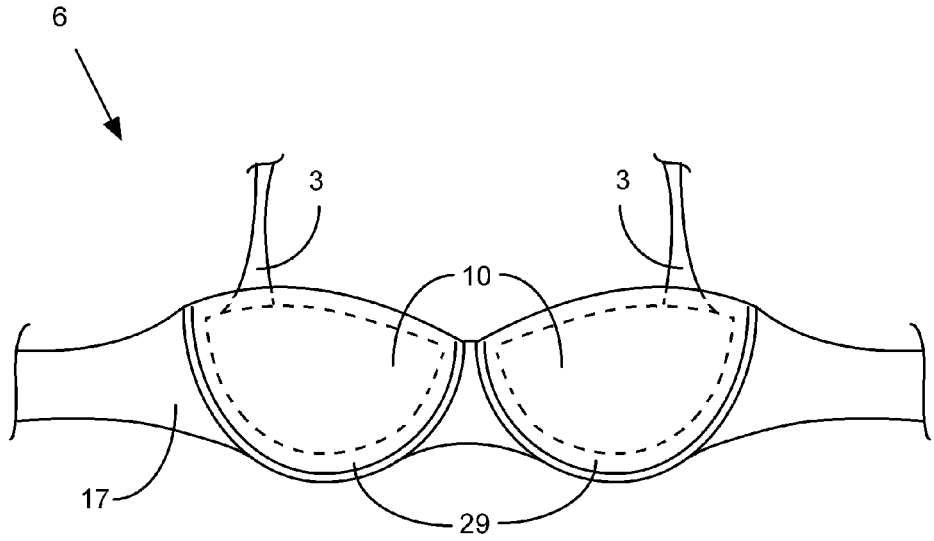
FIG. 11 is a front view of a floating cup brassiere which illustrates the floating cups sandwiched in-between fabric, held by the fabric and bra straps, and shown in the lower position and without attachments.
Figure 12A:
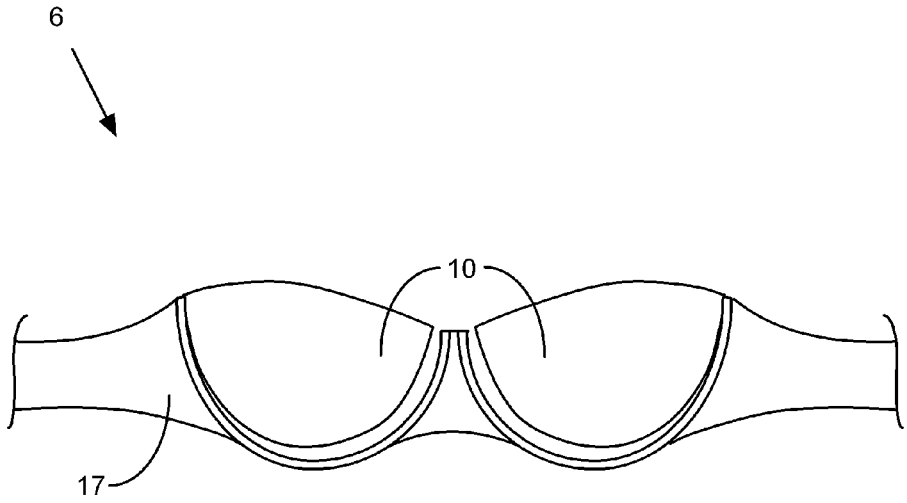
FIGS. 12A-D are front views of floating cup brassieres that illustrate examples of the floating cups attached to the floating cup brassiere without any attachments.
Figure 12B:
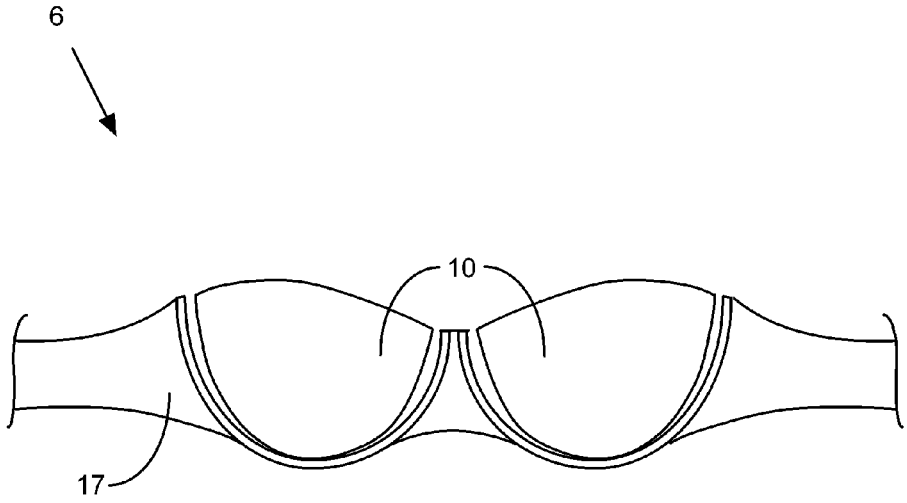
Figure 12C:
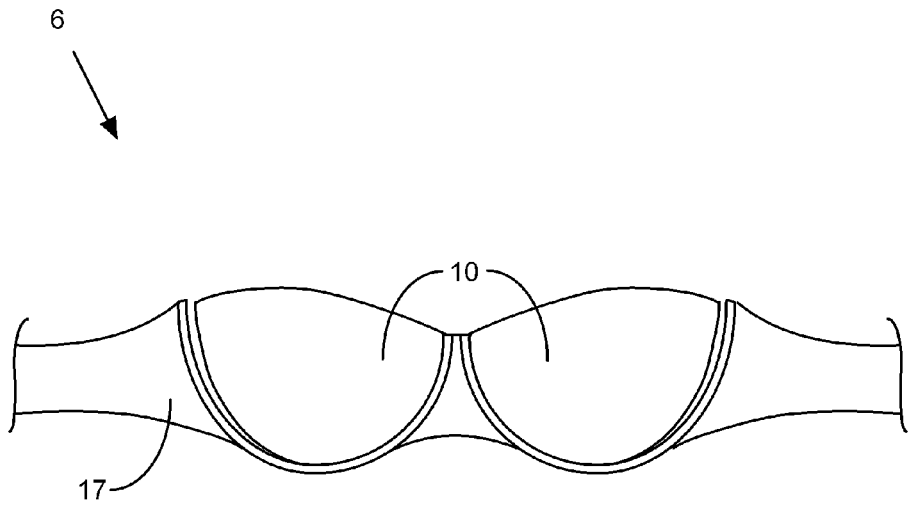
Figure 12D:
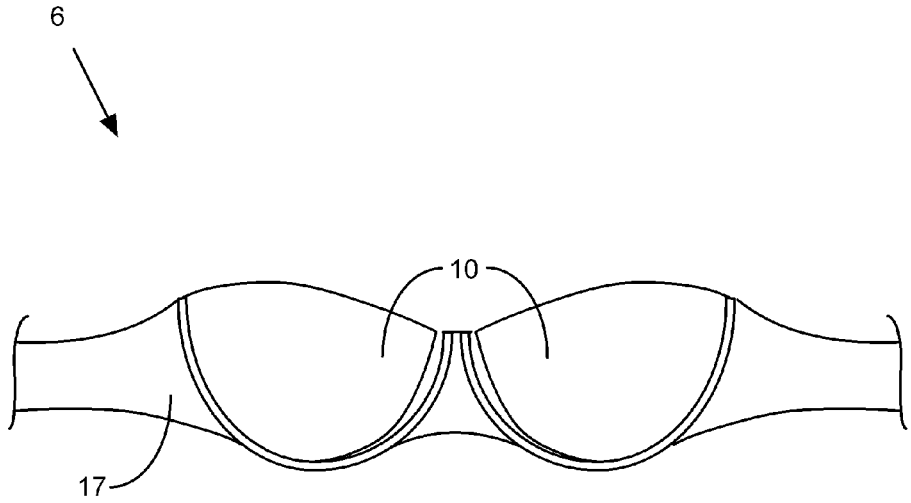

FIG. 11 is a front view of a floating cup brassiere 6 and illustrates the floating cups 10, in dashed lines, sandwiched in-between fabric 29, and held by the fabric 29 and shoulder straps 3. The floating cups 10 are shown in the lower position and without attachments. This figure illustrates the "comfort-lift" adjustable bra cup design. The floating cups 10 can also be a part of a multilayered brassiere. A multilayered brassiere has at least two cups. One cup being fixed to the floating cup brassiere 6 and a floating cup 10 fully or partially detached from the floating cup brassiere 6 such that it is movable and adjustable. Movable and adjustable cups can be placed behind the fixed cup or they can be sandwiched between two fixed cups.

FIGS. 12A-D are front views of floating cup brassieres 6 that illustrate examples of the floating cups 10 attached to the floating cup brassiere 6 without any attachments. The figures illustrate benefits to a wearer. In particular, it shows how the 'give-in' cup feature results in better fitting for in-between breast sizes by providing a range of different attachment locations for the floating cups 10. The more brassiere cup attachment points, the more choices a woman has to find a comfortable brassiere that fits her shape and size. Of course, floating cups 10 can be sandwiched in between fabric, covered with a fabric on the front side, or can be a part of a multilayered cup brassiere.

Figure 13:
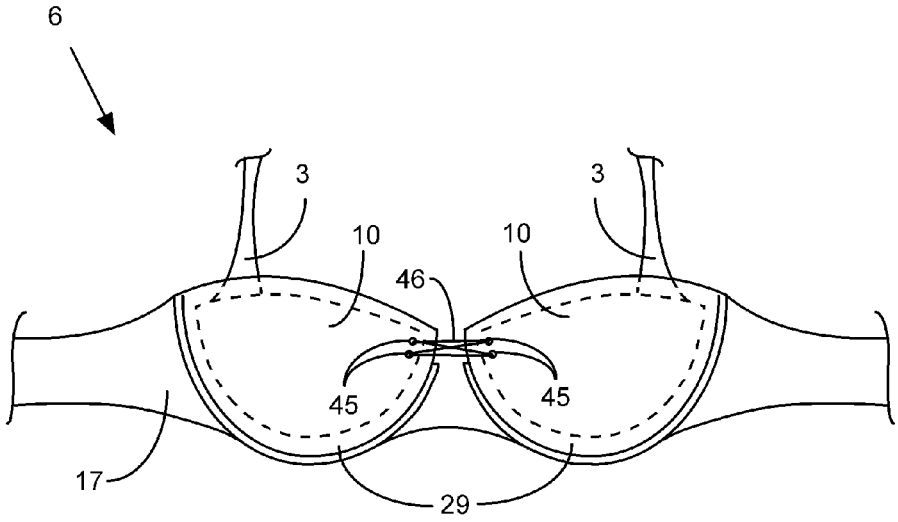
FIG. 13 is a front view of a floating cup brassiere and illustrates the floating cups sandwiched in-between fabric and also using the shoe-string technique which allows floating cups to be brought closer together by tying opposing cups directly together.

FIG. 13 is a front view of a floating cup brassiere 6 that illustrates the floating cups 10 sandwiched in-between fabric 29 and also using the shoe-string technique which allows floating cups 10 to be brought closer together by tying opposing floating cups 10 directly together. The apertures 45 are located near the edge of each floating cup 10. String ties 46 are inserted through the apertures 45 on each floating cup 10 and secured together.

Figure 14A:
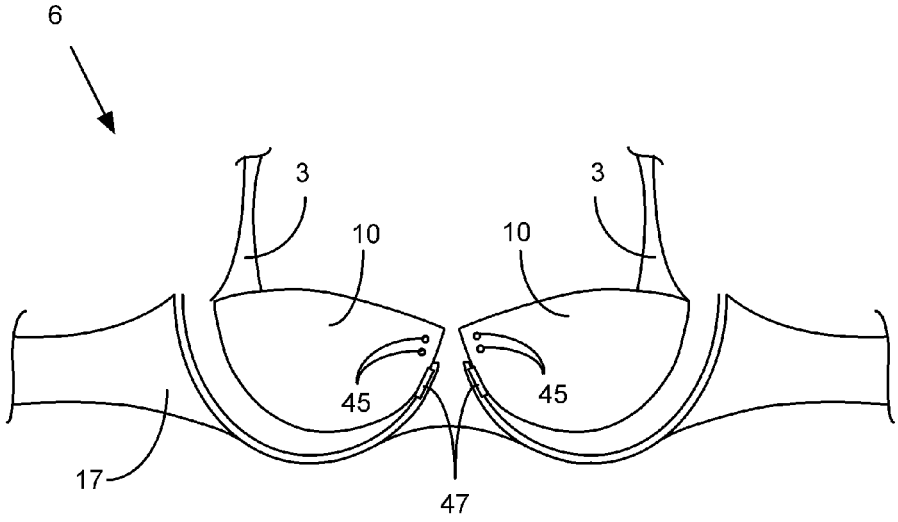
FIG. 14A is a front view of a floating cup brassiere and illustrates the floating cups secured to the brassiere body with a clip.

FIG. 14A is a front view of a floating cup brassiere 6 and illustrates the floating cups 10 secured to the brassiere body 17 with a clip 47. In the preferred embodiment, the clip 47 can be moved to allow the wearer to move the floating cup in relation to the brassiere body 17. Clip 47 can be implemented as a single piece, or as two pieces that interlock. Further, the clip 47 they have several points of attachment to allow the position of the cup to be adjusted. Tie string apertures 45 are also shown. In addition, the floating cups 10 can be detached from the clip 47, the shoulder straps 3 which would allow the brassiere to be worn without a floating cups 10. As a result, the brought cups can be a separate piece from the brassiere 6.

Figure 14B:
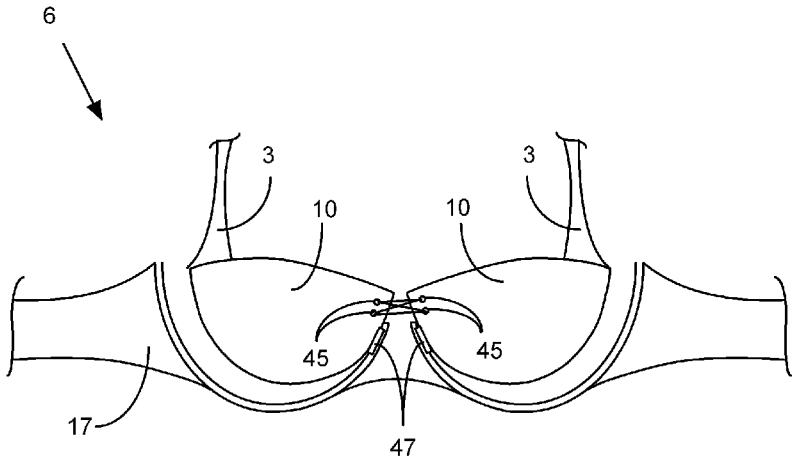
FIG. 14B is a front view of a floating cup brassiere and illustrates the floating cups secured to the brassiere body with a clip, and also shows the shoe-string technique which allows floating cups to be brought closer together by tying opposing cups directly together.

FIG. 14B is a front view of a floating cup brassiere 6 and illustrates the floating cups 10 secured to the brassiere body 17 with a clip 47, and also shows the shoe-string technique which allows floating cups 10 to be brought closer together by tying opposing cups directly together.

The floating cups 10 can be fabricated from any material that will provide suitable comfort and wear characteristics. In addition, it can be a multilayered structure of the outer layers for aesthetic and/or comfort purposes.

Those skilled in the art will realize that for aesthetic purposes, any of the embodiments disclosed herein can be fabricated such that they provide an appearance which is substantially the same. This is possible because the cups can be concealed in a similar fashion. For example, the cups 10 can be sandwiched in between a fabric, in the case of a floating cup 10, they can be connected to the brassiere body 17 with a stretch lace material which gives a similar appearance occurred as a result, many of the embodiments can be designed such that the structural elements of the invention are substantially concealed from view.

In addition to the embodiments described above in regard to brassiere 6, those skilled in the art will recognize that this invention can be implemented in the identical manner in conjunction with the other garments, in particular, bathing suits. In addition, the floating brassiere cups 10 can be separate components that are used in conjunction with conventional brassieres, or can be worn under any top garment.

While the invention has been described with respect to a preferred embodiment thereof, it will be understood by those skilled in the art that various changes in detail may be made therein without departing from the spirit, scope, and teaching of the invention.

I claim:

1. A brassiere having independently positionable floating cups, comprising:

a brassiere body having a pair of floating cups, each independently positionable in relation to the brassiere body, further comprising:

means to movably attach and adjust the floating cups in relation to the brassiere body such that the wearer's cleavage changes when the position of the floating cups is adjusted;

at least one end of each floating cup is attached to the brassiere body that further has floating cup adjustment points and each floating cup is independently movable in relation to the brassiere body and the cup adjustment points; and cup adjustment means for independent adjustment of each floating cup such that each cup is independently moved in relation to one another and in relation to the brassiere body such that the amount of a wearer's cleavage is adjusted for a desired aesthetic effect;

whereby the floating cups are independently adjusted to alter the amount of perceived cleavage when the brassiere is worn, and to compensate for asymmetrical breasts.

2. A brassiere, as in claim 1, further comprising at least one or more decorative fabric covers to conceal the floating cups.

3. A brassiere, as in claim 1, further comprising cup attachment points on the brassiere body for attachment to preselected points on the floating cups.

4. A brassiere, as in claim 3, wherein the floating cup attachment point is a cup retainer that adjusts the position of the floating cup and the cleavage of a wearer's breasts by adjusting the attachment point to move breasts up, down or toward the center.

5. A brassiere, as in claim 3, wherein the cup attachment point is a securing pocket that adjusts the position of the floating cups and the cleavage of a wearer's breasts by selecting a securing pocket to move breasts up, down, or toward the center.

6. A brassiere, as in claim 1, further comprising:

tension straps attached at a first end to a first movable cup, and at a second end to a second movable cup; and tension adjustment means to adjust tension on the movable cups by adjusting the length of the tension straps;

whereby cleavage is adjusted to move the floating cup by increasing or decreasing the tension provided by the tension straps.

7. A method of independently adjusting the floating cups of a brassiere, including the steps of:

securing the floating cups to a brassiere body such that the floating cups are freely movable in relation to the brassiere body; and, independently moving floating cups to adjust the location of the floating cups in relation to the brassiere body;

whereby cleavage is adjusted by moving the breasts to a desired position by selectively moving the floating cups.

8. A method, as in claim 7, including the additional step of adjusting the location of the floating cups with tie strings that attach to apertures in the floating cups;

whereby cleavage is adjusted by using the tie strings to move the floating cup.

9. A method, as in claim 7, including the additional step of adjusting the cleavage of the brassiere by moving the floating cups under control of tension straps.

10. A method, as in claim 7, including the additional step of adjusting the cleavage of the brassiere by using two tension straps, each tension strap attached at a first end to a first floating cup and at a second end to a second floating cup.

11. A method, as in claim 7, including the additional step of connecting the floating cups with stretchable fabric, clips, ties, or elastic strips that attaches the floating cups to the brassiere body;

whereby cleavage is adjusted by adjusting the floating cups with clips, ties, elastic strips, or tie strings.

* * * * *